US009276330B2

(12) United States Patent
Wu et al.

(10) Patent No.: US 9,276,330 B2
(45) Date of Patent: Mar. 1, 2016

(54) CABLE CONNECTOR ASSEMBLY HAVING A CONDUCTIVE ELEMENT FOR CONNECTING GROUNDING LAYERS OF THE CABLE TOGETHER

(71) Applicant: FOXCONN INTERCONNECT TECHNOLOGY LIMITED, Grand Cayman (KY)

(72) Inventors: Jerry Wu, Irvine, CA (US); Jun Chen, Kunshan (CN); Fan-Bo Meng, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/604,770

(22) Filed: Jan. 26, 2015

(65) Prior Publication Data

US 2015/0214672 A1 Jul. 30, 2015

(30) Foreign Application Priority Data

Jan. 24, 2014 (CN) ..... 2014 1 0032336
Dec. 22, 2014 (CN) ..... 2014 2 0812502

(51) Int. Cl.

| | |
|---|---|
| ***H01R 12/24*** | (2006.01) |
| ***H01R 4/28*** | (2006.01) |
| ***H01R 12/77*** | (2011.01) |
| ***H01R 9/03*** | (2006.01) |
| ***H01R 13/6593*** | (2011.01) |

(52) U.S. Cl.

CPC ..... *H01R 4/28* (2013.01); *H01R 9/038* (2013.01); *H01R 12/775* (2013.01); *H01R 13/6593* (2013.01)

(58) Field of Classification Search

USPC ..... 439/497

See application file for complete search history.

(56) References Cited

U.S. PATENT DOCUMENTS

| | | | | |
|---|---|---|---|---|
| 4,975,069 | A * | 12/1990 | Fedder | H01R 12/775 439/101 |
| 7,534,143 | B1 * | 5/2009 | Tsao | H01R 13/58 439/497 |
| 7,717,733 | B1 | 5/2010 | Yi et al. | |
| 8,062,050 | B2 * | 11/2011 | Wu | H01R 13/65802 439/350 |
| 8,133,070 | B2 * | 3/2012 | Hsueh | H01R 9/03 439/497 |
| 8,303,329 | B2 | 11/2012 | Wu | |
| 8,398,427 | B2 * | 3/2013 | Wu | H01R 4/02 439/497 |
| 8,708,718 | B2 * | 4/2014 | Li | H01R 4/027 439/108 |
| 8,721,361 | B2 * | 5/2014 | Wu | H01R 12/598 439/497 |
| 8,794,981 | B1 | 8/2014 | Rodriguez et al. | |
| 8,956,167 | B2 * | 2/2015 | Wu | H01R 13/40 439/497 |

(Continued)

*Primary Examiner* — Tho D Ta

(74) *Attorney, Agent, or Firm* — Wei Te Chung; Ming Chieh Chang

(57) ABSTRACT

A cable connector assembly includes a cable connector comprising an insulative housing and a plurality of conductive terminals mounted in the insulative housing, the conductive terminal having a connecting portion; a cable having a plurality of wires electrically connecting with the connecting portions, the wire comprising a core, an insulative layer enclosing the core, and a grounding layer enclosing the insulative layer, the core extending beyond the grounding layer; and a conductive element electrically connecting with the connecting portion of a selected conductive terminal. The conductive element electrically connects the grounding layers; and the cores of the wires electrically connect with the connecting portions of the remaining conductive terminals.

13 Claims, 10 Drawing Sheets

(56) References Cited

U.S. PATENT DOCUMENTS

2009/0047825 A1* 2/2009 Wu ..... H01R 12/592 439/497
2009/0197459 A1* 8/2009 Yu ..... H01R 4/027 439/497
2011/0256764 A1 10/2011 Wu
2013/0164990 A1* 6/2013 Tsai ..... H01R 13/516 439/660

* cited by examiner

CABLE CONNECTOR ASSEMBLY HAVING A CONDUCTIVE ELEMENT FOR CONNECTING GROUNDING LAYERS OF THE CABLE TOGETHER

BACKGROUND OF THE INVENTION

1. Field of the Invention

The present invention relates to an cable connector assembly, and more particularly to structure of the cable connector connecting with the cable.

2. Description of Related Arts

U.S. Pat. No. 8,794,981, issued on Aug. 5, 2014, discloses a cable connector assembly. The cable connector assembly includes a PCB having a number of contacts, a cord coupled to the contacts on the PCB, and a ground bar coupled with some contact on the PCB. The ground bar may be made of a conductive material. The PCB has a ground node coupling to the ground bar via one or more wires inside the PCB. The ground bar provides grounding to the connector and a mating connector into which the connector is inserted. The cord includes a wire coupled to the ground node.

U.S. Pat. No. 7,534,143, issued on May 19, 2009, discloses a cable connector assembly. The cable connector assembly includes a cable connector and a cable connecting with the cable connector. The cable connector includes an insulative housing and a number of conductive terminals mounted on the insulative housing. The conductive terminal includes two pairs of differential contacts and a grounding contact located between the two pairs of differential contacts for preventing cross-talk. The cable includes first set of wires and second set of wires. The second set wires include a pair of differential pairs, a grounding conductor, and an outer jacket enclosing the differential pair and the grounding conductor. The grounding contact has a tail portion defining a pair of wire-receiving slots communicating with each other and forming an angle therebetween. The grounding conductors are angled out from the outer jackets and toward each other to be received and soldered in the wire-receiving slots of the tail portion of the grounding contact.

Hence, the existing cable connector only connect with a kind of cable. When needing another kind of cable, structures of the cable connectors need be redesigned.

SUMMARY OF THE INVENTION

An object of the present invention is to provide an cable connector. The cable connector can connect with two kinds of cables.

To achieve the above-mentioned object, a cable connector assembly includes a cable connector comprising an insulative housing and a plurality of conductive terminals mounted in the insulative housing, the conductive terminal having a connecting portion; a cable having a plurality of wires electrically connecting with the connecting portions, the wire comprising a core, an insulative layer enclosing the core, and a grounding layer enclosing the insulative layer, the core extending beyond the grounding layer; and a conductive element electrically connecting with the connecting portion of a selected conductive terminal. The conductive element electrically connects the grounding layers; and the cores of the wires electrically connect with the connecting portions of the remaining conductive terminals.

According to the present invention, the conductive element makes the assembly convenient for adapting to different kinds of cable wires.

DETAILED DESCRIPTION OF THE PREFERRED EMBODIMENT

Reference will now be made in detail to a preferred embodiment of the present invention.

Figure 1:
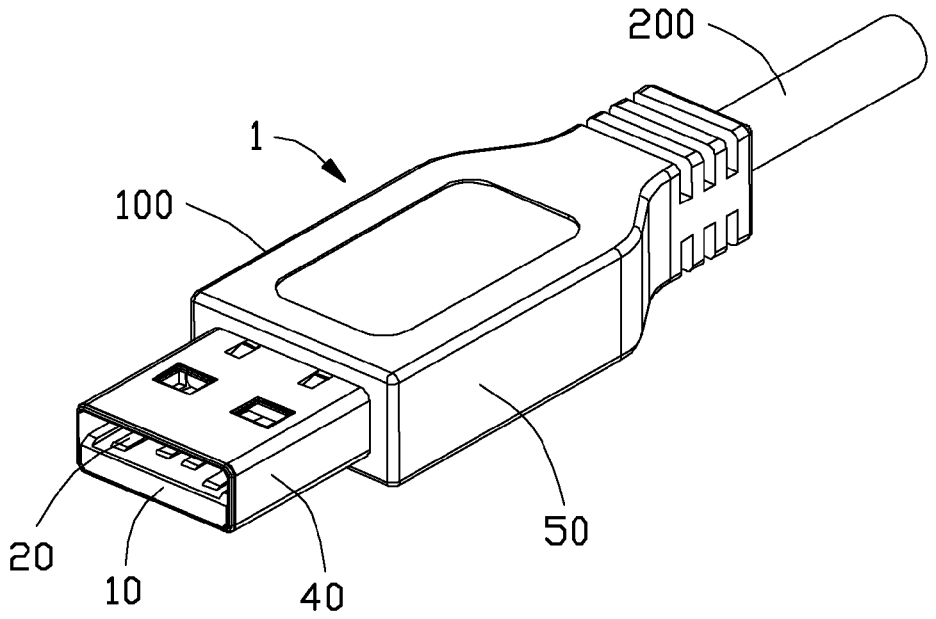
FIG. 1 is a perspective view of a cable connector assembly in accordance with a first embodiment of the present invention.
Figure 2:
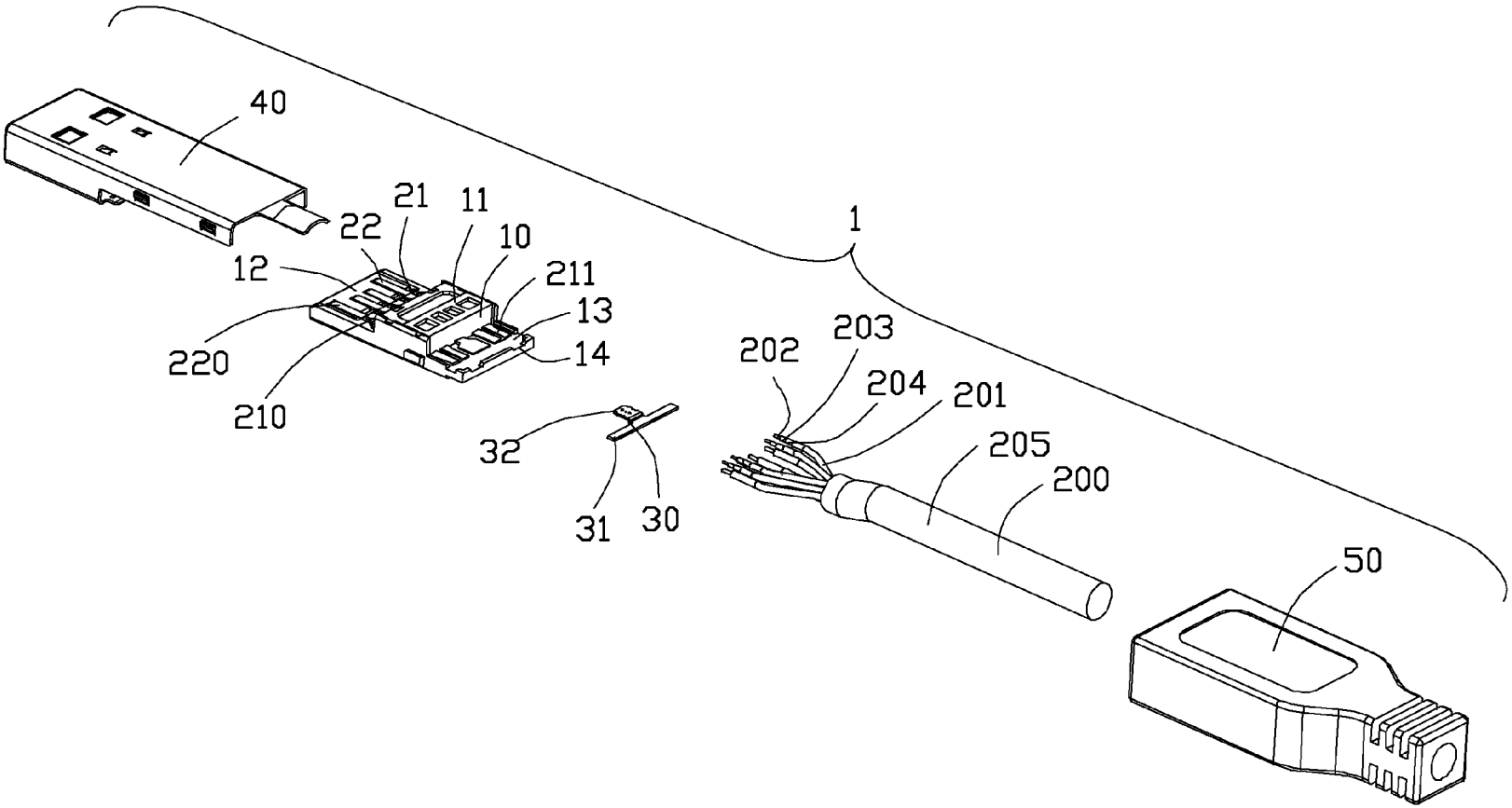
FIG. 2 is an exploded view of the cable connector assembly as shown in FIG. 1.
Figure 3:
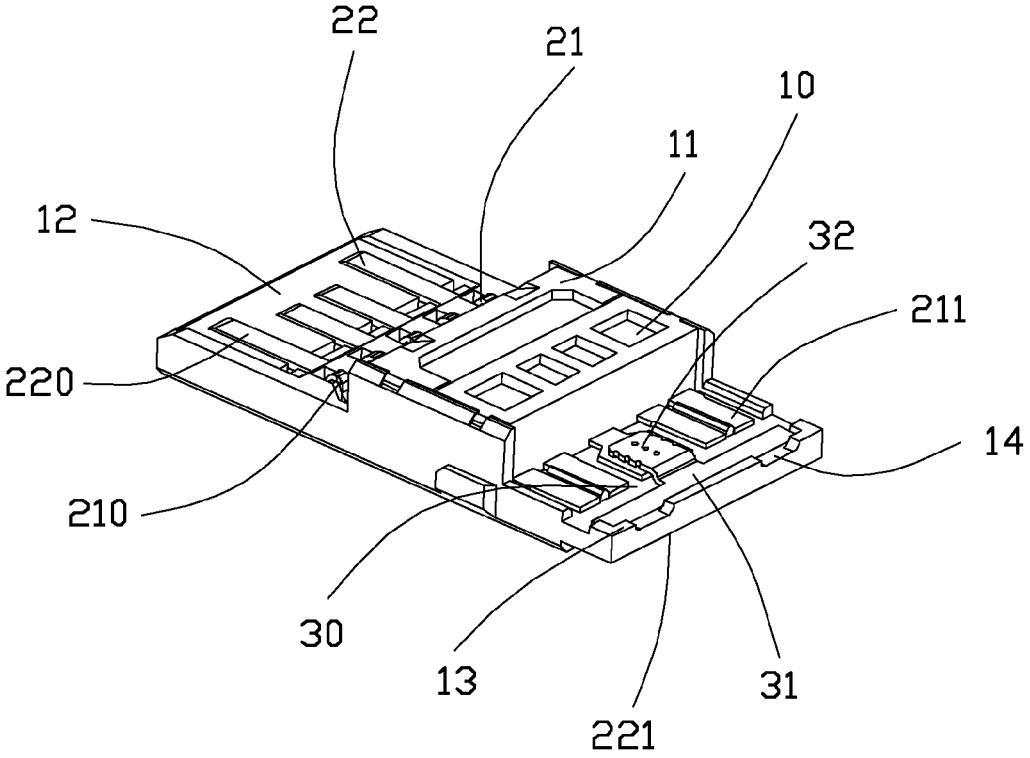
FIG. 3 is another exploded view of the cable connector assembly as shown in FIG. 1.
Figure 4:
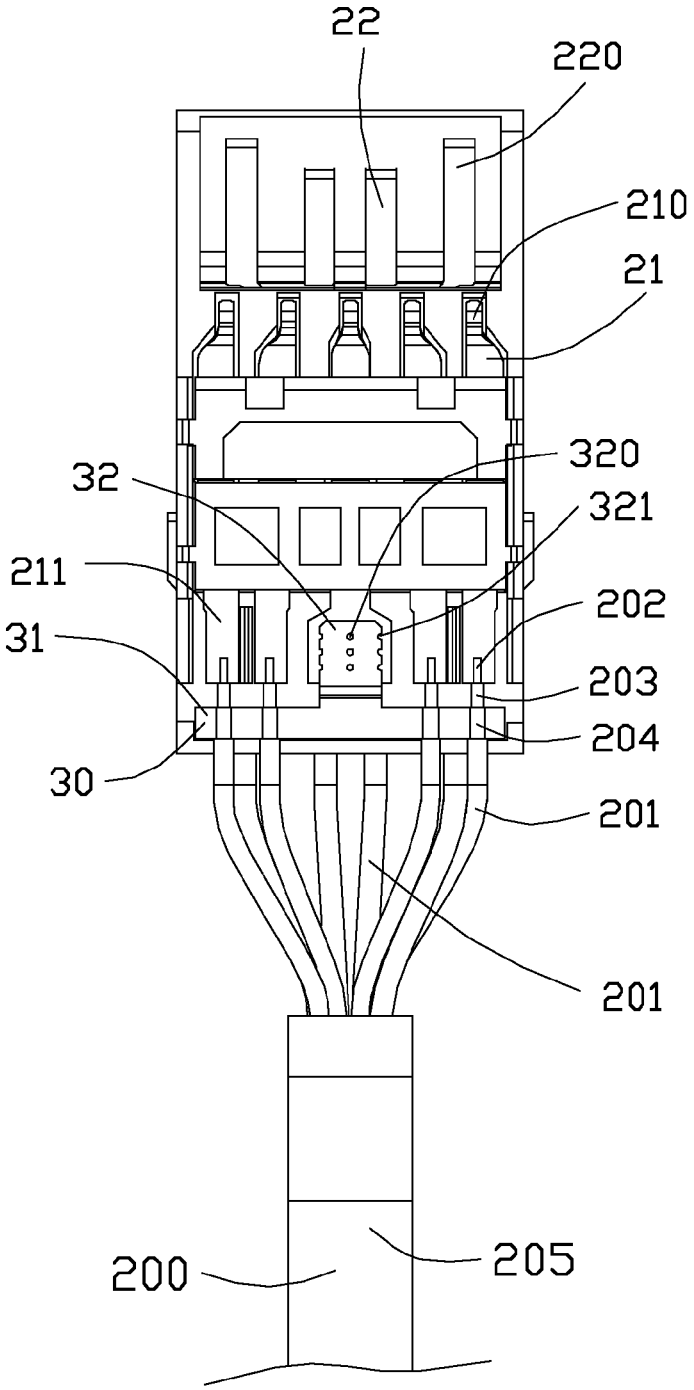
FIG. 4 is a vertical view of the cable connecting with the connecting portions of the conductive terminals as shown in FIG. 1.

Referring to FIGS. 1 to 4, a cable connector assembly 1 includes a cable connector 100 and a cable 200 connecting with the cable connector 100. The cable connector 100 includes an insulative housing 10, a number of conductive terminals 20 mounted on the insulative housing 10, a conductive element 30 behind the conductive terminals 20, a shielding shell 40 enclosed the insulative housing 10, and a plastic mold 50 forming on the shielding shell 40 and the cable 200. The cable 200 includes a number of wires 201 and an outer layer 205 enclosed the wires 201. The wire 201 includes a core 202, an insulative layer 203 enclosed the core 202, and a grounding layer 204 enclosed the insulative layer 203. In this embodiment, the cable connector 100 conforms USB 3.0 or above the standard of the USB 3.0. The wires 201 are coaxial line.

The insulative housing 10 includes a base 11, a tongue plate 12 forward extending from the base 11, and a supporting portion 13 backward extending from the base 11. The base 11 is thicker than the tongue plate 12 and the supporting portion 13. The insulative housing 10 defines a number of position grooves 14 receiving the wires 201 for welding easily.

The conductive terminals 20 includes five first terminals 21 and four second terminals 22. The five first terminals 21 include two pairs of signal terminals for transmitting the high speed signal and a grounding terminal between the two pairs of the signal terminals. Speed of each pair of the signal terminals is 10 G/s. The four second terminals 22 transmit the signal of the USB 2.0. The first terminal 21 has a first contact section 210 in front end and a first connecting portion 211 in rear end for welding with the wire 201 of the cable 200. The first connecting portions 211 are arranged in a row. The second terminal 22 has a second contact section 220 in front end and a second connecting portion 221 in rear end for welding with the wire 201 of the cable 200. The second connecting portions 221 are arranged in another row. The wires 201 are arranged two rows. One row of the wires 201 weld with the first connecting portions 211, and the other row of the wires 201 weld with the second connecting portions 221. The first contact sections 210 are behind the second contact seconds 220. The first connecting portions 211, the first contact sections 210, and the second contact sections 220 are in a same side of the insulative housing 10, and the second connecting portions 221 are in opposite side of the insulative housing 10. The first contact sections 210 are bending and elastic of the structure, the second contact sections 220 are flat and non elastic of the structure.

The conductive element 30 includes a main body 31 being parallel to the arrangement direction of the first connection portions 211 and a contact end 32 forward extending from the main body 31. The contact end 32 electrically connects with a first connecting portion 211 of the grounding terminal. A length of the main body 31 is larger than the length of a row of first connecting portions 211. So the grounding layers 204 of the wires 201 welding on the main body 31 more conveniently. The contact end 32 has a number of holes 320 in the middle and a number of cutouts 321 in two sides. The holes 320 and the cutouts 321 make the contact end 32 to weld with the selected first connecting portion 211 more easily.

The cable connector 100 can also connect with a shielded twisted pair cable. The shielded twisted pair cable has a number of signal wires and grounding wires. Both of the signal wires and the grounding wires are arranged side by side. At this time, the grounding wire can directly weld with the first connecting portion 211 of the grounding terminal or the contact end 32. The cable connector 100 can weld with two kinds of cables, so then generality of the cable connector 100 is increased.

Figure 5:
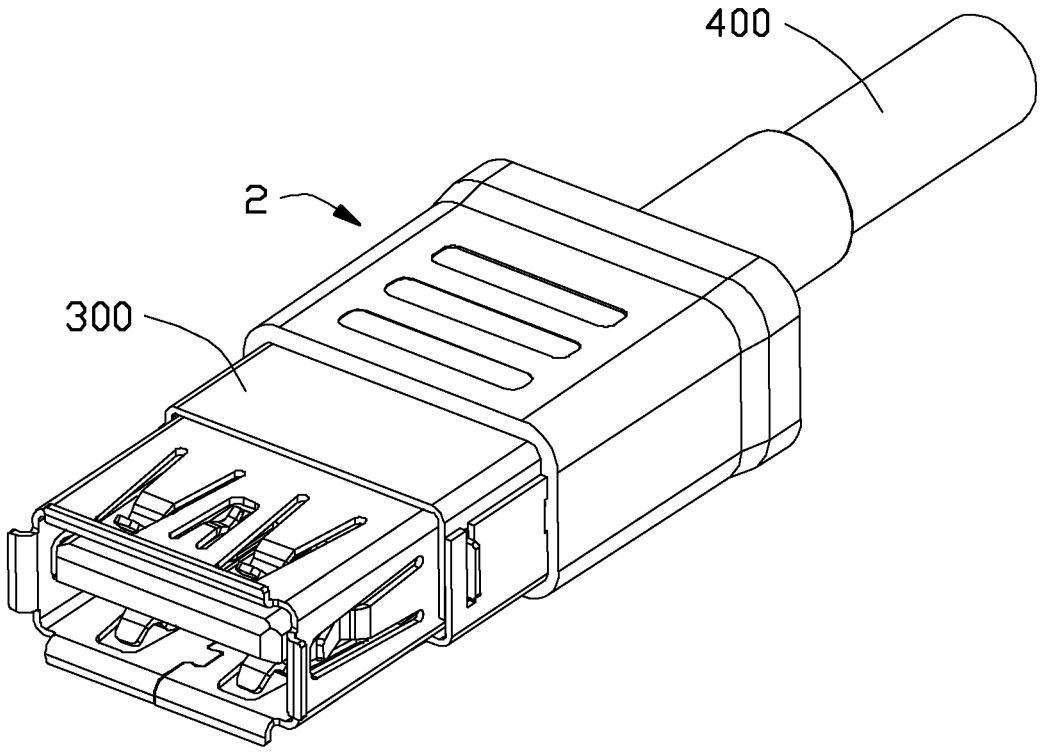
FIG. 5 is a perspective view of a cable connector assembly in accordance with a second embodiment of the present invention.
Figure 6:
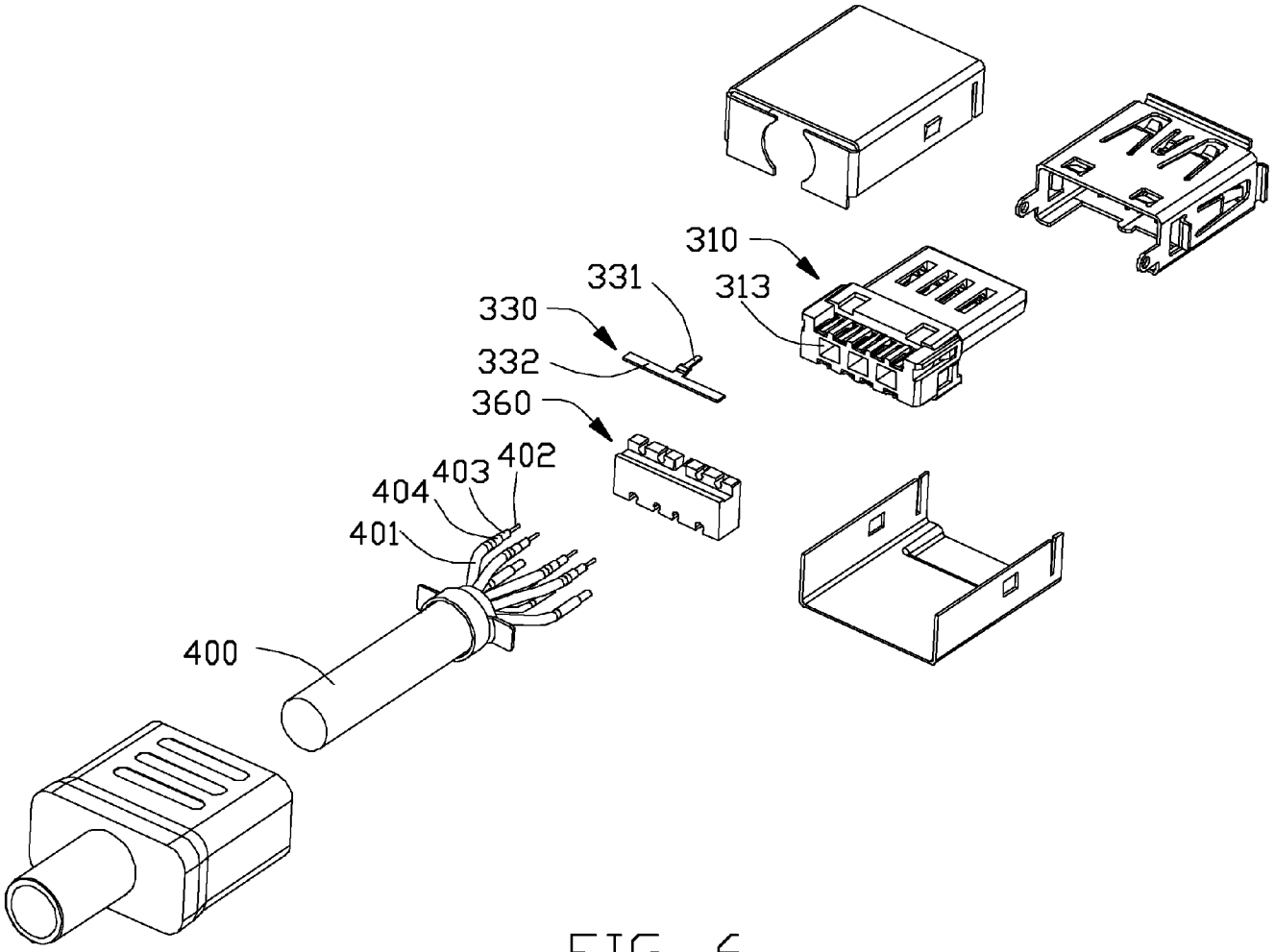
FIG. 6 is an exploded view of the cable connector assembly as shown in FIG. 5.
Figure 7:
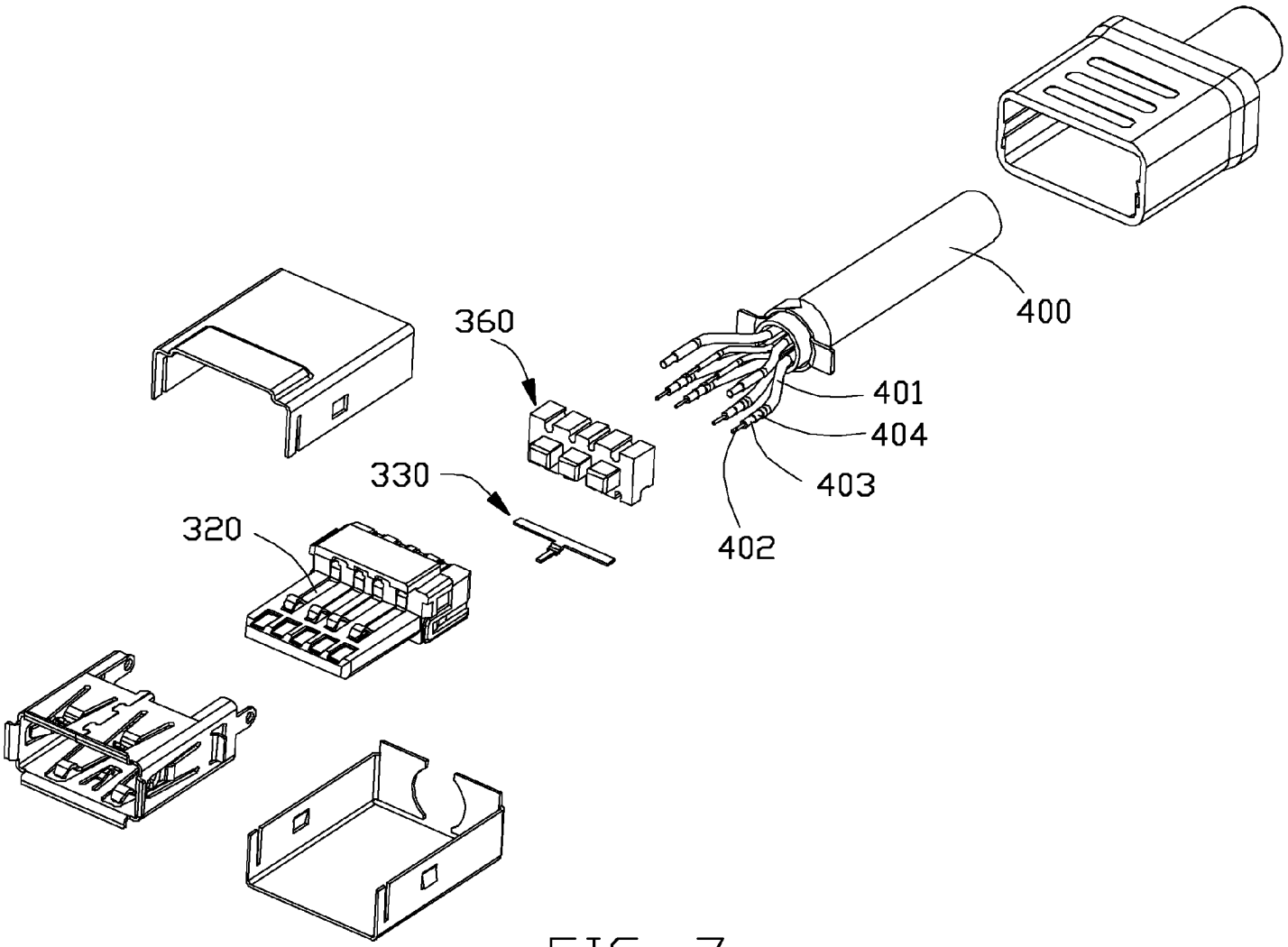
FIG. 7 is another exploded view of the cable connector assembly as shown in FIG. 5.
Figure 8:
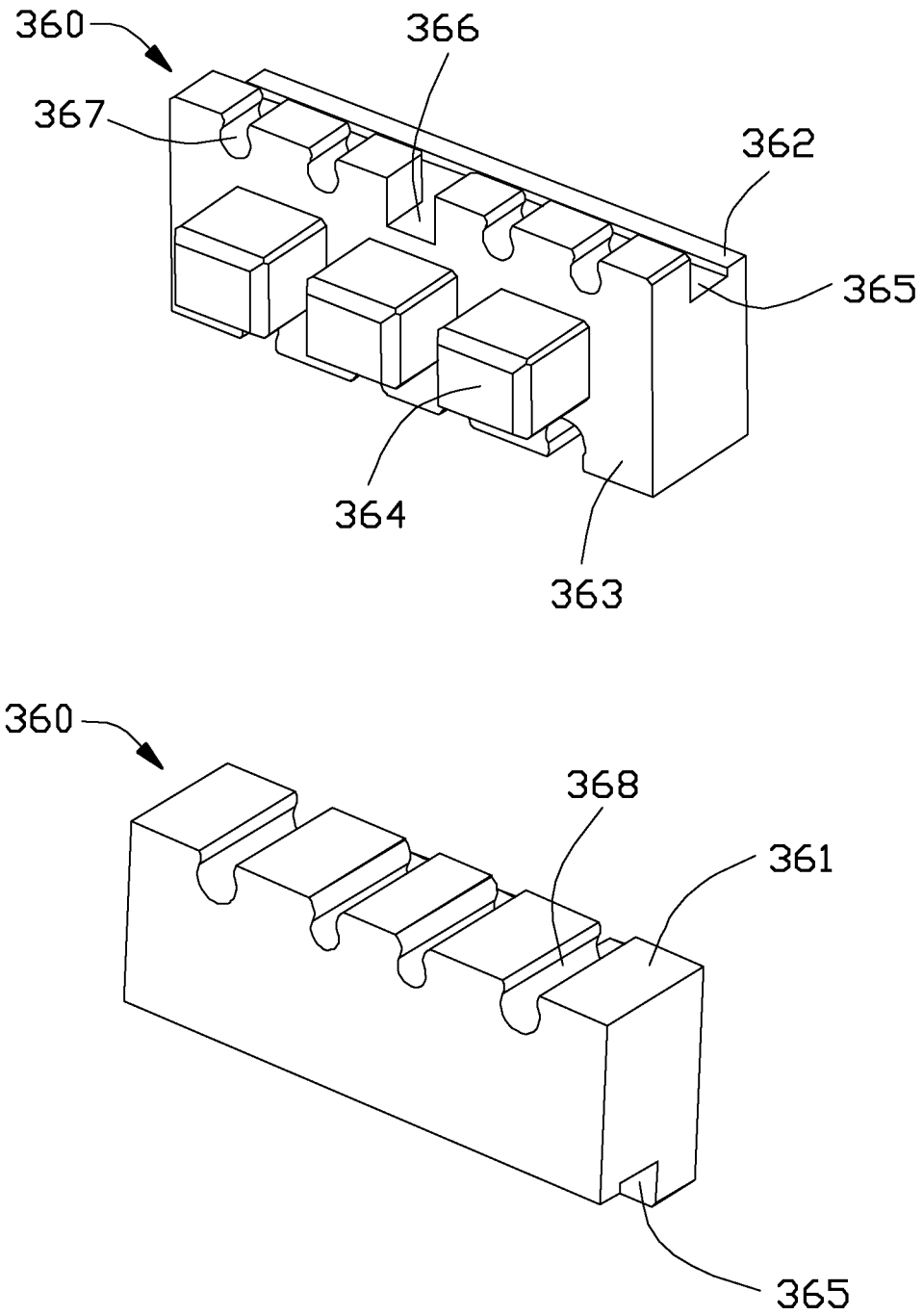
FIG. 8 is two different angles perspective views of a sorting block.
Figure 9:
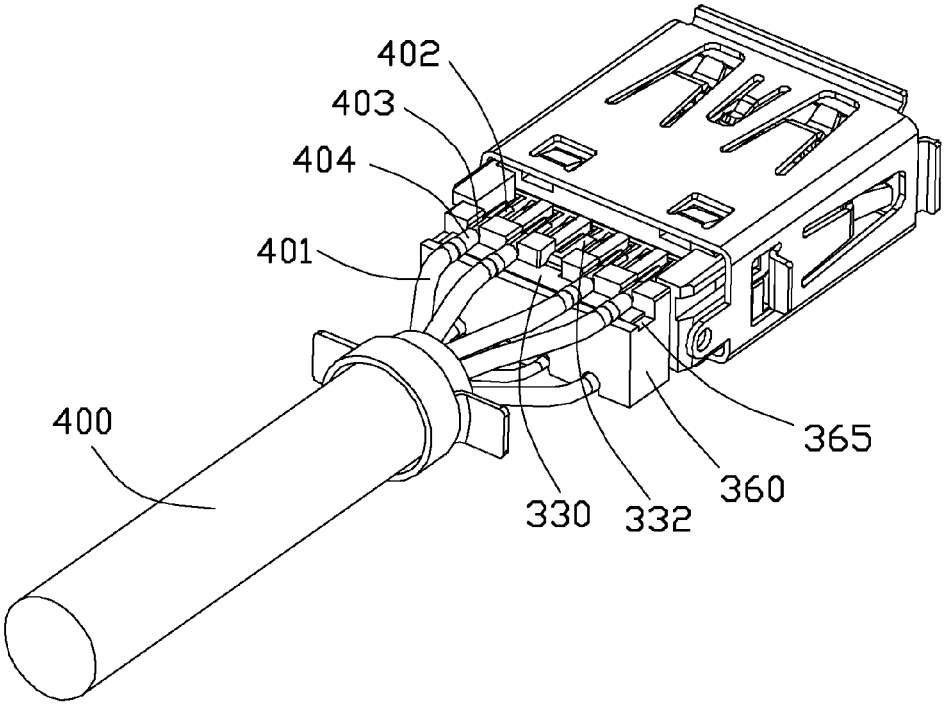
FIG. 9 is a perspective view of a cable welding with a conductive element on the sorting block.
Figure 10:
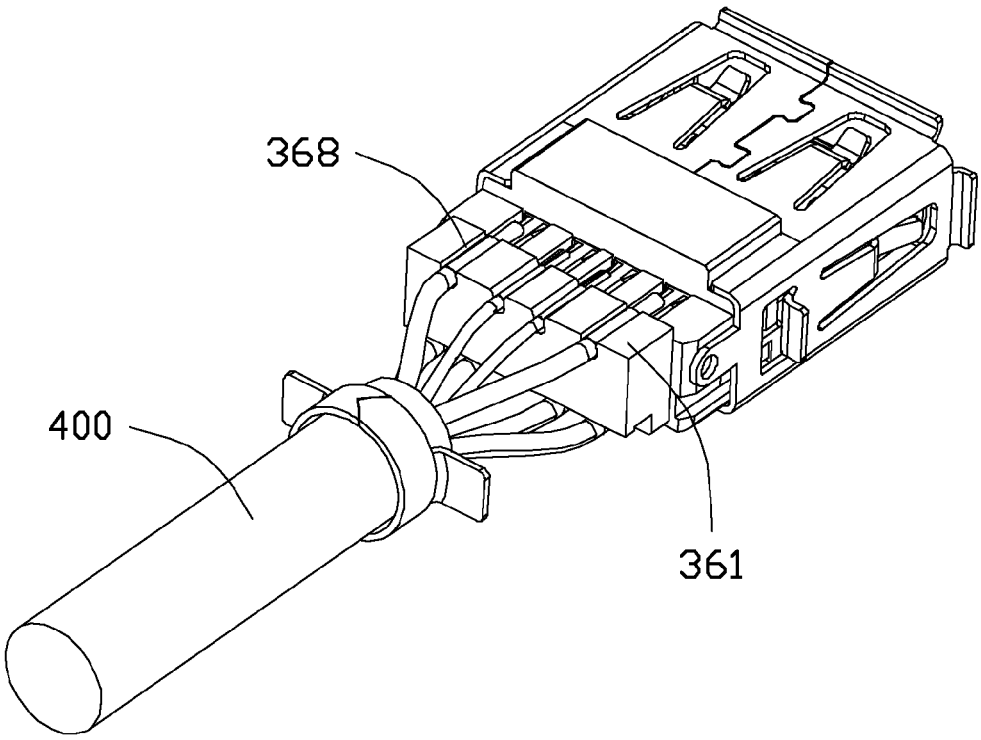
FIG. 10 is a perspective view of the cable received in another side of the sorting block as shown in FIG. 9.

Referring to FIGS. 5 to 10, a cable connector assembly 2 in accordance with a second embodiment of present invention comprises a cable connector 300 and a cable 400 connecting with the cable connector 300. The main difference between the second embodiment and the first embodiment is as follows. The cable connector 300 includes an insulative housing 310, a number of conductive terminals 320, a sorting block 360 mounted on the insulative housing 310, and a conductive element 330 mounted on the sorting block 360. The cable 400 includes a number of wires 401. The wire 401 includes a core 402, an insulative layer 403 enclosed the core 402, and a grounding layer 404 enclosed the insulative layer 403.

The insulative housing 310 has three mounting holes 313 in the rear end face. The sorting block 360 has an upper surface 361, a bottom surface 362, a front surface 363 connecting with the upper surface 361 and the bottom surface 362, and three mounting posts 364 forward extending from the front surface 363. The mounting posts 364 receive in the mounting holes 313. So the sorting block 360 can directly mount on an existing insulative housing 310. The insulative housing 310 do not need remark.

The bottom surface 362 defines a first slot 365 and a second slot 366 forward extending from the first slot 365, and a number of first position grooves 367 in two sides of the second slot 366. The first slot 365 connects with the second slot 366. The conductive element 330 includes a main body 331 and a contact end 332 forward extending from the main body 331. The main body 331 is received in the first slot 365. The contact end 322 is received in the second slot 366 and extends beyond the second slot 366 to weld with selected conductive terminal 320. The upper surface 361 of the sorting block 360 defines a number of second position grooves 368. The wires 401 respectively receive in the corresponding first position grooves 367 and second position grooves 368.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly comprising:

a cable connector comprising an insulative housing and a plurality of conductive terminals mounted in the insulative housing, the conductive terminal having a connecting portion;

a cable having a plurality of wires electrically connecting with the connecting portions, the wire comprising a core, an insulative layer enclosing the core, a grounding layer enclosing the insulative layer, the core extending beyond the grounding layer; and a conductive element electrically connecting with the connecting portion of a selected conductive terminal; and a sorting block mounted on the insulative housing, and wherein the conductive element is mounted on the sorting block, wherein the conductive element electrically connects the grounding layers; and the cores of the wires electrically connect with the connecting portions of the remaining conductive terminals;

wherein the sorting block comprises an upper surface, a bottom surface, and a front surface, the bottom surface having a first slot and a second slot extending from the first slot, and wherein the conductive element comprises a main body and a connecting portion extending from the main body, the main body received in the first slot, the connecting portion received in the second slot and extending beyond the second slot;

wherein the conductive terminals comprises a plurality of first terminals and second terminals, the connecting portions of the first terminals and the second terminals are arranged in two rows;

wherein each of the first terminals and the second terminals having a contact section, the contact sections of the first terminals being positioned behind the contact sections of the second terminals;

wherein the conductive element comprises a main body parallel to the arrangement direction of the connection portions and a contact end electrically connecting with the selected conductive terminal.

2. The cable connector assembly as recited in claim 1, wherein the connection portions the contact sections of the first terminals, and the contact sections of the second terminals are in one side of the insulative housing, and wherein the connecting portions of the second terminals are in the other side of the insulative housing.

3. The cable connector assembly as recited in claim 1, wherein the contact sections of the first terminals are bent and elastic, the contact sections of the second terminals are flat and non-elastic.

4. The cable connector assembly as recited in claim 1, wherein the contact end of the conductive element has a plurality of holes.

5. The cable connector assembly as recited in claim 1, wherein the contact end has a plurality of cutouts.

6. The cable connector assembly as recited in claim 1, wherein length of the main body is larger than length of a row of connecting portions.

7. The cable connector assembly as recited in claim 1, wherein the insulative housing has a plurality of position grooves fixing the wires.

8. The cable connector assembly as recited in claim 1, wherein the sorting block defines a plurality of position grooves for fixing the wires.

9. The cable connector assembly as recited in claim 1, wherein the sorting block has a plurality of mounting posts forward extending from the front surface, and the insulative housing has a plurality of mounting holes receiving the mounting posts.

10. A cable connector assembly comprising:

an insulative housing equipped with a plurality of contacts arrange in one row along a transverse direction, each of said contacts including a front contacting section and a rear connecting section in a front-to-back direction perpendicular to said transverse direction;

a conductive element having a main body extending along the transverse direction corresponding to an occupied area of said contacts in said transverse direction, and an extension along the front-to-back direction corresponding to one selected contact of said contacts;

a cable including a plurality wires located behind the housing, each of said contacts includes an inner conductive core soldered upon the rear connecting section of the corresponding contact, and a grounding layer encircling said inner core with front end mechanically and electrically connected to the main body; wherein said extension is mechanically and electrically connected to the connecting section of said selected one contact;

wherein said conductive element is retained upon an insulative sorting block which is attached on a rear side of the housing and defines a plurality of position grooves extending along the front-to-back direction and spaced from one another along the said transverse direction to receive and regulate the corresponding wires therein.

11. The cable connector assembly as claimed in claim 10, wherein said conductive element is retained upon a rear portion of the housing.

12. The cable connector assembly as claimed in claim 10, further including a plurality of terminals arranged in another row along the transverse direction in the housing, and said sorting block further including another row of position grooves to receive the corresponding wires connected to said terminals.

13. The cable connector assembly as claimed in claim 10, wherein no wire is mechanically and electrically directly connected to the selected contact.

* * * * *